US007182424B2

(12) United States Patent
Kubota

(10) Patent No.: US 7,182,424 B2
(45) Date of Patent: Feb. 27, 2007

(54) INK JET RECORDING PROCESS FOR DETECTING DOT OMISSION OF CLEAR INK AND APPARATUS FOR CONDUCTING THE PROCESS

(75) Inventor: Kazuhide Kubota, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 118 days.

(21) Appl. No.: 10/761,802

(22) Filed: Jan. 21, 2004

(65) Prior Publication Data

US 2005/0116978 A1 Jun. 2, 2005

(30) Foreign Application Priority Data

Jan. 22, 2003 (JP) ..... P2003-013564
Jan. 22, 2003 (JP) ..... P2003-013565

(51) Int. Cl.
*B41J 29/393* (2006.01)
*B41J 2/165* (2006.01)

(52) U.S. Cl. ..... 347/19; 347/23

(58) Field of Classification Search ..... 347/19, 347/23

See application file for complete search history.

(56) References Cited

U.S. PATENT DOCUMENTS 5,898,443 A * 4/1999 Yoshino et al. ..... 347/19

FOREIGN PATENT DOCUMENTS

JP 2002-192740 7/2000

* cited by examiner

*Primary Examiner*—Julian D. Huffman
(74) *Attorney, Agent, or Firm*—Ladas & Parry LLP

(57) ABSTRACT

An ink jet recording process having the steps of applying an image formation ink and a clear ink one over the other onto a recording medium with a recording head to form a mixed dot, and detecting dot omission, in which the presence or absence of dot omission of the clear ink is judged by measuring the diameter of the mixed dot. Also, an ink jet recording process having the steps of applying an image formation ink and a reactive clear ink one over the other onto a recording medium with a recording head to form a mixed dot, and detecting dot omission, the presence of absence of dot omission of the reactive clear ink is judged by measuring the image density of the mixed dot. Ink jet recording apparatus for conducting these ink jet recording processes are also disclosed.

3 Claims, 3 Drawing Sheets

INK JET RECORDING PROCESS FOR DETECTING DOT OMISSION OF CLEAR INK AND APPARATUS FOR CONDUCTING THE PROCESS

FIELD OF THE INVENTION

The present invention relates to an ink jet recording process and an ink jet recording apparatus.

BACKGROUND OF THE INVENTION

Ink jet recording is, as well known, a process in which an ink jet recording ink is ejected as droplets through minute nozzles to form many dots on the surface of a recording medium, thereby recording images such as letters or figures on paper, etc.

As such ink jet recording, there have been developed and put to practical use a process in which an electric signal is converted to a mechanical signal by the use of an electrostrictive element to intermittently ejecting an ink stored in a nozzle head section, thereby recording letters or symbols on the surface of a recording medium; and a process in which an ink stored in a nozzle head section is rapidly heated at a portion very close to an ejection portion to generate bubbles, and intermittently ejected by volume expansion due to the bubbles to record letters or symbols on a surface of a recording medium.

According to the ink jet recording, it is possible to print high-resolution, high-quality images at high speed by an easy way. In particular, the ink jet recording has recently become an image formation method substitutable for a photographic method in color printing.

As inks that can be used in the ink jet recording, there have been widely known an aqueous dye ink containing a dye as a colorant and an aqueous pigment ink containing a pigment as a colorant. The aqueous pigment ink has the advantage that printed matter excellent in weather resistance can be prepared. However, when used alone, the pigment is difficult to dissolve in an aqueous solvent. Accordingly, the aqueous pigment ink usually contains a polymer type dispersing agent for dispersing the pigment at a specified concentration.

Meanwhile, for example, when photographic tone images are reproduced by the ink jet recording, the ink jet recording is usually carried out so as to increase the density of dots for a region having high print density and to decrease the density of dots for a region having low print density.

However, particularly, the use of the above-mentioned aqueous pigment ink as the ink results in the presence of the aqueous pigment ink in the region in which the density of dots is increased (high duty region) in larger amounts, compared to that in the region in which the density of dots is decreased (low duty region), and accordingly results in the presence of the polymer type dispersing agent in larger amounts. The polymer type dispersing agent usually has glossiness, so that the high duty region of printed matter shows a high gloss, and the low duty region shows a low gloss. Accordingly, there has been the problem that when the printed matter is observed as a whole, uneven gloss becomes obvious depending on the contents of an image to be reproduced.

In order to solve this problem, there has been known a technique of further printing the above-mentioned printed matter with a clear ink capable of imparting glossiness in such amounts that the amount thereof in the low duty region is larger than that in the high duty region, thereby intending to decrease the difference in glossiness between the high duty region and the low duty region and to solve the problem of the above-mentioned uneven gloss.

On the other hand, in order to maintain the quality of images obtained by the ink jet recording, the absence of dot omission is required. The term "dot omission" means the phenomenon that no dot is formed at a position where the dot is originally to be formed because of, for example, troubles in nozzles of a recording head mounted on an ink jet recording apparatus.

As a method for detecting the dot omission, there has been known a method, as shown in FIG. 5, of providing a light emitting unit 113 for emitting light L and a light receiving unit 114 for receiving the above-mentioned light L so that an ink 111 passes therebetween from a recording head 110 to paper 112, subsequently, continuously flying the ink 111 at predetermined intervals, thereby forming a detection pulse based on intermittent interception of the above-mentioned light L with the above-mentioned ink 111, and comparing the pulse interval of the detection pulse with a specified threshold value (see patent document 1).

Patent Document: JP 2002-192740 A

However, the method described in patent document 1 detects the dot omission by inspecting whether the light L emitted from the light emitting unit 113 is intercepted with the ink 111 at predetermined timing or not, when the ink 111 is allowed to drop from the recording head 110 at proper timing. Accordingly, when a clear ink or a reactive clear ink is used, it has been difficult to detect the dot omission of the clear ink or the reactive clear ink, because the light L is difficult to be intercepted therewith.

SUMMARY OF THE INVENTION

The invention has been made in view of such a problem, and a first object of the invention is to provide an ink jet recording process which can reliably detect dot omission of a clear ink when an image formation ink and the clear ink are recorded one over the other on a recording medium, and an ink jet recording apparatus which can reliably reproduce an image.

A second object of the invention is to provide an ink jet recording process which can reliably detect dot omission of a reactive clear ink when an image formation ink and the reactive clear ink are recorded one over the other on a recording medium, and an ink jet recording apparatus which can reliably reproduce an image.

Other objects and effects of the invention will become apparent from the following description.

(1) The present inventors discovered that when an image formation ink and a clear ink are recorded one over the other, the dot diameter thereof is enlarged compared to that of the ink alone (first finding). The first object of the invention has been achieved based on the above-mentioned first finding (this aspect of the invention is hereinafter referred to as "first invention"). That is, the technical constitution and effects of the first invention are as follows:

(1.1) An ink jet recording process comprising the steps of applying an image formation ink and a clear ink one over the other onto a recording medium with a recording head to form a mixed dot; and detecting dot omission, in which the presence or absence of dot omission of the clear ink is judged by measuring the diameter of the mixed dot.

The mixed dot in which the dot omission of the clear ink has occurred is constituted by, for example, only the image formation ink, and the diameter thereof is not enlarged or insufficiently enlarged compared to the case where the dot omission of the clear ink has not occurred. The degree of the diameter enlargement in the normal state can be known beforehand from the result of the case where the dot omission of the clear ink has not occurred, so that the presence or absence of the dot omission of the clear ink can be judged by measuring the diameter of the mixed dot as in the above-described process.

(1.2) The ink jet recording process described in the above (1.1), wherein the dot omission detecting step is a step of judging the dot omission of the clear ink as absent when the diameter of the mixed dot exceeds a specified reference value, and judging the dot omission of the clear ink as present when the diameter of the mixed dot is equal to or less than the specified reference value.

For example, when the reference value is set within the range of from the "diameter of the dot of only the image formation ink" to the "diameter of the dot comprising the image formation ink and the clear ink one over the other" as in the above-mentioned embodiment, the dot omission of the clear ink can be judged more reliably.

(1.3) The ink jet recording process described in the above (1.2), wherein a single dot is formed in a region on the recording medium other than the region where the mixed dot is formed, by independently recording the image formation ink, and the reference value is prepared based on the diameter of the single dot.

According to such a process, the single dot can be prepared under the same conditions as those (the kind of image formation ink and recording medium, environmental conditions (humidity and temperature), etc.) applied to the preparation of the mixed dot. The above-mentioned conditions can be reliably reflected in the diameter of such a single dot, so that the reference value prepared based thereon is high in reliability. Accordingly, the dot omission of the clear ink can be judged more reliably by this embodiment.

(1.4) The ink jet recording process described in the above (1.3), wherein the reference value is prepared so as to satisfy the following equation:

$$\text{Reference value} = \text{Diameter of single dot} + \alpha$$

wherein $\alpha \geqq 0$.

The dot omission of the clear ink can be reliably judged by preparing the reference value so as to satisfy the equation described above.

(1.5) The ink jet recording process described in any one of the above (1.1) to (1.4), wherein the clear ink has a surface tension of 40 mN/m or less.

According to such a process, the difference between the "diameter of the dot of only the image formation ink" and the "diameter of the dot comprising the image formation ink and the clear ink one over the other" can be sufficiently secured, so that the dot omission of the clear ink can be judged more easily.

(1.6) The ink jet recording process described in any one of the above (1.1) to (1.5), which further comprises a step of carrying out ink jet recording when the dot omission of the clear ink is judged as absent by the dot omission detecting step, and carrying out cleaning of the recording head when the dot omission of the clear ink is judged as present by the dot omission detecting step.

Conventionally, in the case where the recording head is intended to be actuated again after it has not been actuated for a long period of time because of a shutdown of printing etc., the recording head is usually forcedly cleaned. However, according to this embodiment, in the case where the printing is resumed, the ink jet recording can be resumed without conducting the cleaning of the recording head, when the dot omission of the clear ink is judged as absent. Accordingly, a burden such as the time taken for the cleaning can be reduced.

(1.7) An ink jet recording apparatus capable of applying an image formation ink and a clear ink one over the other onto a recording medium with a recording head to form a mixed dot, which comprises:

a dot diameter measuring unit capable of measuring the diameter of the mixed dot;

a judging unit capable of judging the presence or absence of dot omission of the clear ink depending on the diameter of the mixed dot;

a cleaning mechanism capable of cleaning the recording head; and a control unit capable of selecting either "ink jet recording with the recording head" or "cleaning of the recording head with the cleaning mechanism" depending on the result of the judgment by the judging unit.

According to such constitution, the presence or absence of the dot omission of the clear ink is judged depending on the diameter of the mixed dot, and further either "ink jet recording with the recording head" or "cleaning of the recording head with the cleaning mechanism" can be selected by the result of this judgment. Accordingly, the ink jet recording apparatus which can reliably reproduce an image constituted by the above-mentioned mixed dots can be obtained.

(2) Further, the present inventors discovered that when an image formation ink and a transparent reactive clear ink are recorded one over the other, the image density of dots thereof increases compared to that of dots of the ink alone (second finding). The second object of the invention has been achieved based on the above-mentioned second finding (this aspect of the invention is hereinafter referred to as "second invention"). That is, the technical constitution and effects of the second invention are as follows:

(2.1) An ink jet recording process comprising the steps of:

applying an image formation ink and a reactive clear ink one over the other onto a recording medium with a recording head to form a mixed dot; and detecting dot omission, in which the presence or absence of dot omission of the reactive clear ink is judged by measuring the image density of the mixed dot.

The mixed dot in which the dot omission of the reactive clear ink has occurred is constituted, for example, by only the image formation ink, and the image density thereof does not increase or insufficiently increases compared to the case where the dot omission of the reactive clear ink has not occurred. The degree of the increase in image density in the normal state can be known beforehand from the result of the case where the dot omission of the reactive clear ink has not occurred, so that the presence or absence of the dot omission of the reactive clear ink can be judged by measuring the image density of the mixed dot as in the above-described process.

(2.2) The ink jet recording process described in the above (2.1), wherein the dot omission detecting step is a step of judging the dot omission of the reactive clear ink as absent when the image density of the mixed dot exceeds a specified reference value, and judging the dot omission of the reactive clear ink as present when the image density of the mixed dot is equal to or less than the specified reference value.

For example, when the reference value is set within the range of from "the image density of the dot of only the image formation ink" to "the image density of the dot comprising the image formation ink and the reactive clear ink one over the other" in the above-mentioned embodiment, the dot omission of the reactive clear ink can be judged more reliably.

(2.3) The ink jet recording process described in the above (2.2), wherein a single dot is formed in a region on the recording medium other than the region where the mixed dot is formed, by independently recording the image formation ink, and the reference value is prepared based on the image density of the single dot.

According to such a process, the single dot can be prepared under the same conditions as those (the kind of image formation ink and recording medium, environmental conditions (humidity and temperature), etc.) applied to the preparation of the mixed dot. The above-mentioned conditions can be reliably reflected in the image density of such a single dot, so that the reference value prepared based thereon is high in reliability. Accordingly, the dot omission of the reactive clear ink can be judged more reliably by this embodiment.

(2.4) The ink jet recording process described in the above (2.3), wherein the reference value is prepared so as to satisfy the following equation:

$$\text{Reference value}=\text{Image density of single dot}+\alpha$$

wherein $\alpha \geqq 0$.

The dot omission of the reactive clear ink can be reliably judged by preparing the reference value so as to satisfy the equation described above.

(2.5) The ink jet recording process described in any one of the above (2.1) to (2.4), which further comprises a step of carrying out ink jet recording when the dot omission of the reactive clear ink is judged as absent by the dot omission detecting step, and carrying out cleaning of the recording head when the dot omission of the reactive clear ink is judged as present by the dot omission detecting step.

Conventionally, in the case where the recording head is intended to be actuated again after it has not been actuated for a long period of time because of a shutdown of printing etc., the recording head is usually forcedly cleaned. However, according to this embodiment, in the case where the printing is resumed, the ink jet recording can be resumed without conducting the cleaning of the recording head, when the dot omission of the reactive clear ink is judged as absent. Accordingly, a burden such as the time taken for the cleaning can be reduced.

(2.6) An ink jet recording apparatus capable of applying an image formation ink and a reactive clear ink one over the other onto a recording medium with a recording head to form a mixed dot, which comprises:

an image density measuring unit capable of measuring the image density of the mixed dot;

a judging unit capable of judging the presence or absence of dot omission of the reactive clear ink depending on the image density of the mixed dot;

a cleaning mechanism capable of cleaning the recording head; and a control unit capable of selecting either "ink jet recording with the recording head" or "cleaning of the recording head with the cleaning mechanism" depending on the result of the judgment by the judging unit.

According to such constitution, the presence or absence of the dot omission of the reactive clear ink is judged depending on the image density of the mixed dot, and further either "ink jet recording with the recording head" or "cleaning of the recording head with the cleaning mechanism" can be selected by the result of the judgment. Accordingly, the ink jet recording apparatus which can reliably reproduce an image constituted by the above-mentioned mixed dots can be obtained.

Figure 1:
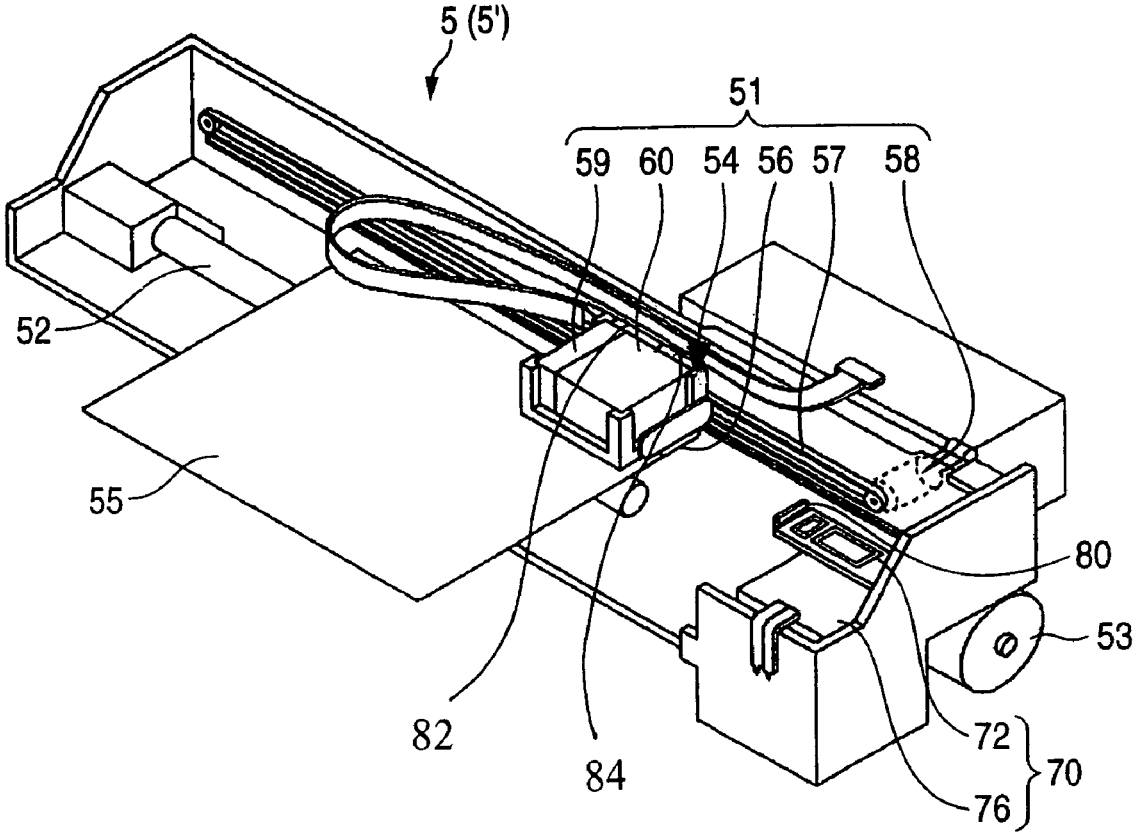
FIG. 1 is a schematic view showing an ink jet recording apparatus according to an embodiment of the invention.

The reference numbers in the drawings designate the followings, respectively:

5, 5': Ink Jet Recording Apparatus
51: Printing Unit
52: Discharge Roller
53: Driven Roller
54: Carriage
55: Recording Paper
56, 110: Recording Head
57: Timing Belt
58: Carriage Motor
59: (Reactive) Clear Ink Cartridge
60: Image Formation Ink Cartridge
70: Ink Waste Water Conveying Unit
72: Capping Member
76: Pump (Suction Pump)
80: Wiping Member
111: Ink
112: Paper
113: Light Emitting Element
114: Light Receiving Element
C1, C2, Cm: Ejection Orifices for (Reactive) Clear Ink
$P_{11}$, $P_{12}$, $P_{1m}$, $P_{n1}$, $P_{n2}$, $P_{nm}$: Ejection Orifices for Image Formation Ink
SD1, SD2, SDm: Single Dots
MD1, MD2, MDm: Mixed Dots

DETAILED DESCRIPTION OF PREFERRED EMBODIMENTS

The ink jet recording process and ink jet recording apparatus according to embodiments of the invention are illustrated with reference to the drawings below.

The ink jet recording process according to an embodiment of the first invention can be suitably conducted using an ink jet recording apparatus 5 according to an embodiment of the first invention shown in FIG. 1.

First, the ink jet recording apparatus 5 according to the embodiment of the first invention will be illustrated in detail. The ink jet recording apparatus 5 is an ink jet recording apparatus capable of applying an image formation ink and a clear ink one over the other onto a recording medium with a recording head to form a mixed dot, and comprises a dot diameter measuring unit capable of measuring the diameter of the mixed dot, a judging unit capable of judging the presence or absence of dot omission of the clear ink depending on the diameter of the mixed dot, a cleaning mechanism capable of cleaning the recording head, and a control unit capable of selecting either "ink jet recording with the recording head" or "cleaning of the recording head with the cleaning mechanism" depending on the result of the judgment by the judging unit.

More particularly, the ink jet recording apparatus 5 has a printing unit 51, a discharge roller 52 and a driven roller 53 driven by the discharge roller 52. Recording paper 55 on which an image has been recorded in the printing unit 51 is discharged by being pinched with the discharge roller 52 and the driven roller 53, as shown in FIG. 1.

The printing unit 51 has a carriage 54 for placing an ink cartridge thereon, a recording head 56 which is disposed on the carriage 54 on the side facing to the recording paper 55 and ejects an ink, a timing belt 57, a carriage motor 58, a clear ink cartridge 59 and an image formation ink cartridge 60.

Further, this ink jet recording apparatus 5 is provided with an ink waste water conveying unit 70 for conveying as waste water the ink discharged from the recording head 56 of the printing unit 51 and a wiping member 80, as the above-mentioned cleaning mechanism.

The ink waste water conveying unit 70 has a capping member 72 for sealing ejection orifices of the recording head 56, and a pump 76. Foreign matter in the ejection orifices of the recording head 56 and the ink ejected to the capping member 72 are sucked with the pump 76 to be discharged.

The above-mentioned capping member 72 is disposed in a so-called home position outside a printing region as a supply path of the recording paper 55.

The wiping member 80 has elasticity and disposed in the vicinity of an end on a recording region side of the capping member 72. This wiping member 80 is injection molded integrally with the capping member 72 by a two-color formation process.

In this ink jet recording apparatus 5, the carriage motor 58 drives the timing belt 57, whereby the carriage 54 is guided by a guide shaft (not shown) to move back and forth at substantially right angles to a feeding direction of the recording paper 55.

The above-mentioned recording head 56 is mounted on the carriage 54 on the side facing to the recording paper 55. The clear ink cartridge 59 and image formation ink cartridge 60 for supplying the ink to the recording head 56 are detachably attached to an upper part of the recording head 56.

Figure 2:
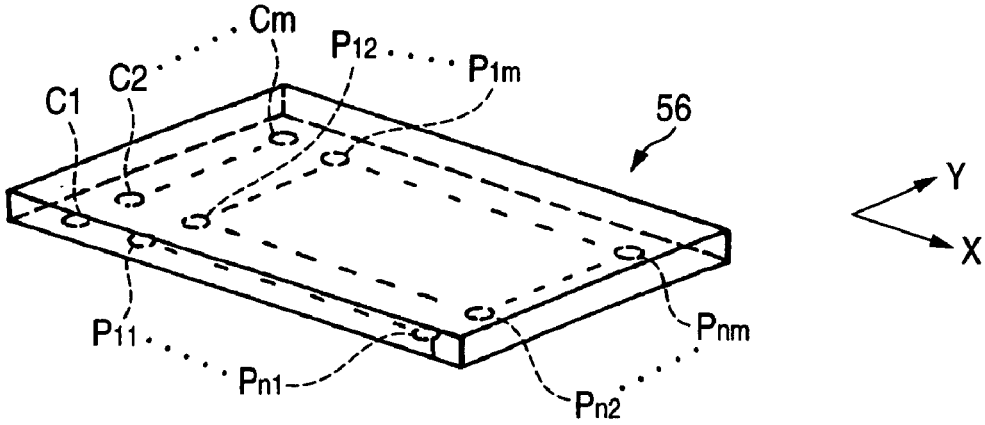
FIG. 2 is a schematic view showing a recording head with which an ink jet recording apparatus according to an embodiment of the invention is equipped.

As shown in FIG. 2, the recording head 56 is provided with ejection orifices C1 to Cm for the clear ink and ejection orifices $P_{11}$ to $P_{nm}$ for the image formation ink, on the side facing to the recording paper 55, wherein n represents an integer of 1 or more and indicates the order of the ejection orifices for the image formation ink in the X direction, whereas m represents an integer of 1 or more and indicates the order of the ejection orifices for the clear ink and the image formation ink in the Y direction.

Further, the carriage 54 is equipped with a CCD camera (not shown) as a dot diameter measuring device capable of measuring the diameter of a dot on the recording paper 55.

The CCD camera is electrically connected to a judging device (not shown) capable of judging the presence or absence of dot omission of the clear ink depending on the dot diameter measured with the CCD camera, and this judging device is electrically connected to a control device (not shown) having the above-mentioned function. A reference value d to be compared to the dot diameter measured with the CCD camera has been stored in the judging device beforehand. The reference value is appropriately set in view of the kind of clear ink, image formation ink and recording medium, external environmental conditions (humidity and temperature), etc. Further, the control device is constituted so that when the dot omission of the clear ink is judged as absent by the judging device, it actuates the recording head 56 to carry out the ink jet recording, and when the dot omission of the clear ink is judged as present, it actuates the cleaning mechanism to clean the recording head 56.

Then, the ink jet recording process according to an embodiment of the first invention using the ink jet recording apparatus 5 will be illustrated.

Figure 3:
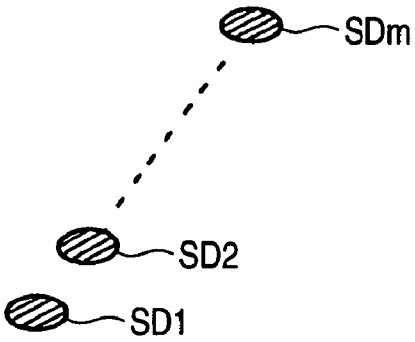
FIG. 3 is a view for illustrating an ink jet recording process according to an embodiment of the invention.
Figure 3:
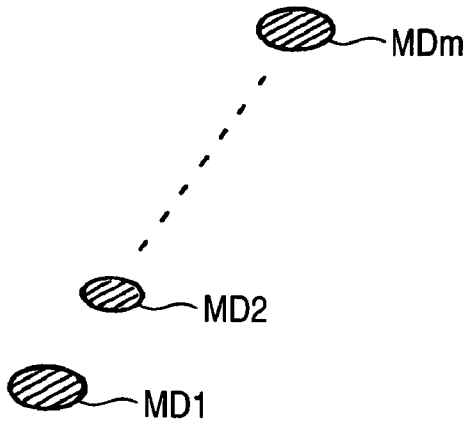

First, single dots SD1 to SDm are formed at specified positions on the recording medium as shown in FIG. 3(*a*), using any one line of orifices in the Y direction of the ejection orifices $P_{11}$ to $P_{nm}$ for the image formation ink provided on the recording head 56 (m is the same as described above). As the recording medium, there can be employed a known medium such as plain paper or a recording medium for ink jet recording (a recording medium having on a surface thereof an ink receiving layer for receiving an ink jet recording ink).

Secondly, the clear ink is ejected from the ejection orifices C1 to Cm for the clear ink provided on the recording head 56 so as to cover the single dots SD1 to SDm to prepare mixed dots MD1 to MDm as shown in FIG. 3(*b*) (m is the same as described above). In this specification, the term "mixed dot" means a dot on a recording medium after the ejection operation of the clear ink has been conducted, regardless of whether the ejection orifices C1 to Cm for the clear ink have a fault or not.

Then, the diameters d1 to dm of the mixed dots MD1 to MDm are measured with the CCD camera (m is the same as described above). The diameters d1 to dm measured are compared to the specified reference value d set beforehand to thereby detect the dot omission of the clear ink (dot omission detecting step). In this embodiment, the reference value d is set within the range of the "diameter of the dot of only the image formation ink" to the "diameter of the dot comprising the image formation ink and the clear ink one over the other". When the diameters d1 to dm of the mixed dots exceed the reference value d, the dot omission of the clear ink is judged as absent, and when the diameters of the mixed dots are equal to or less than the reference value d, the dot omission of the clear ink is judged as present. For example, when the diameter d1 of the mixed dot MD1 exceeds d, the dot omission of the clear ink is judged as absent, and it is regarded that the clear ink has been ejected from the ejection orifice C1 for the clear ink without a problem. On the other hand, when the diameter d2 of the mixed dot MD2 is d or less, the dot omission of the clear ink is judged as present, and it is regarded that a defect of some kind has been developed in the ejection orifice C2 for the clear ink, whereby the clear ink has not been normally ejected.

As the image formation inks, there can be used any of known aqueous dye inks and aqueous pigment inks.

Here, the aqueous pigment ink usually contains a pigment such as an inorganic pigment or an organic pigment, and a polymer type dispersing agent for dispersing the pigment.

The inorganic pigments include titanium oxide, iron oxide and carbon black. The organic pigments include an azo pigment (including an azo lake pigment, an insoluble azo pigment, a condensed azo pigment and a chelate azo pigment), a polycyclic pigment (including a phthalocyanine pigment, a perylene pigment, a perynone pigment, an anthraquinone pigment, a quinacridone pigment, a dimethylquinacridone pigment, a dioxane pigment, a thioindigo pigment, an isoindolinone pigment, a quinofuranone pigment and a diketopyrrolopyrrole pigment), a nitro pigment, a nitroso pigment and aniline black.

More particularly, examples of the pigments used in black inks include carbon blacks such as No. 2300, No. 900, MCF88, No. 33, No. 40, No. 45, No. 52, MA7, MA8, MA100 and No. 2200B manufactured by Mitsubishi Chemical Corporation, Raven C, Raven 5750, Raven 5250, Raven 5000, Raven 3500, Raven 1255 and Raven 700 manufactured by Columbian Carbon Company, Regal 400R, Regal 330R, Regal 660R, Mogul L, Monarch 700, Monarch 800, Monarch 880, Monarch 900, Monarch 1000, Monarch 1100, Monarch 1300 and Monarch 1400 manufactured by Cabot Corporation, and Color Black FW1, Color Black FW2, Color Black FW2V, Color Black FW18, Color Black FW200, Color Black S150, Color Black S160, Color Black S170, Pintex 35, Pintex U, Pintex V, Pintex 140U, Special Black 6, Special Black 5, Special Black 4A and Special Black 4 manufactured by Degussa Corporation. The pigments used in yellow inks include C.I. Pigment Yellow 1, C.I. Pigment Yellow 2, C.I. Pigment Yellow 3, C.I. Pigment Yellow 12, C.I. Pigment Yellow 13, C.I. Pigment Yellow 14, C.I. Pigment Yellow 16, C.I. Pigment Yellow 17, C.I. Pigment Yellow 73, C.I. Pigment Yellow 74, C.I. Pigment Yellow 75, C.I. Pigment Yellow 83, C.I. Pigment Yellow 93, C.I. Pigment Yellow 95, C.I. Pigment Yellow 97, C.I. Pigment Yellow 98, C.I. Pigment Yellow 109, C.I. Pigment Yellow 110, C.I. Pigment Yellow 114, C.I. Pigment Yellow 128, C.I. Pigment Yellow 129, C.I. Pigment Yellow 151, C.I. Pigment Yellow 154 and C.I. Pigment Yellow 180. Further, the pigments used in magenta inks include C.I. Pigment Red 5, C.I. Pigment Red 7, C.I. Pigment Red 12, C.I. Pigment Red 48 (Ca), C.I. Pigment Red 48 (Mn), C.I. Pigment Red 57 (Ca), C.I. Pigment Red 57:1, C.I. Pigment Red 112, C.I. Pigment Red 122, C.I. Pigment Red 123, C.I. Pigment Red 168, C.I. Pigment Red 184 and C.I. Pigment Red 202. The pigments used in cyan inks include C.I. Pigment Blue 1, C.I. Pigment Blue 2, C.I. Pigment Blue 3, C.I. Pigment Blue 15, C.I. Pigment Blue 15:3 C.I. Pigment Blue 15:34, C.I. Pigment Blue 16, C.I. Pigment Blue 22, C.I. Pigment Blue 60, C.I. Vat Blue 4 and C.I. Vat Blue 60. However, the pigments are not limited thereto.

The content of the pigment is preferably from 4 to 15% by weight, and more preferably 4 to 8% by weight, based on the total amount of the ink.

Preferred examples of the polymer type dispersing agents include natural polymers, and specific examples thereof include proteins such as glue, gelatin, casein and albumin; natural gums such as gum Arabic and tragacanth gum; glucosides such as saponin; alginic acid derivatives such as alginic acid, alginic acid-propylene glycol ester, triethanolamine alginate and ammonium alginate; and cellulose derivatives such as methyl cellulose, carboxymethyl cellulose, hydroxyethyl cellulose and ethylhydroxy cellulose. Further, preferred examples of the polymer type dispersing agents also include synthetic polymers. Specific examples thereof include polyvinyl alcohol derivatives; polyvinylpyrrolidone derivatives; acrylic resins such as polyacrylic acid, an acrylic acid-acrylonitrile copolymer, a potassium acrylate-acrylonitrile copolymer, a vinyl acetate-acrylate copolymer and an acrylic acid-acrylate copolymer; styrene-acrylic resins such as a styrene-acrylic acid copolymer, a styrene-methacrylic acid copolymer, a styrene-methacrylic acid-acrylate copolymer, a styrene-α-methylstyrene-acrylic acid copolymer and a styrene-α-methylstyrene-acrylic acid-acrylate copolymer; a styrene-maleic acid copolymer; a styrene-maleic anhydride copolymer; a vinylnaphthalene-acrylic acid copolymer; a vinylnaphthalene-maleic acid copolymer, vinyl acetate-based copolymers such as a vinyl acetate-ethylene copolymer, a vinyl acetate-fatty acid vinyl ethylene copolymer, a vinyl acetate-maleic acid ester copolymer, a vinyl acetate-crotonic acid copolymer and a vinyl acetate-acrylic acid copolymer; and salts thereof. Of these, a copolymer of a hydrophobic group-containing monomer and a hydrophilic group-containing monomer, and a polymer obtained from a monomer having both a hydrophobic group and a hydrophilic group in its molecular structure are particularly preferred. The copolymer may be either a random copolymer or a block copolymer. The above-mentioned salts include salts of diethylamine, ammonium, ethylamine, triethylamine, propylamine, isopropylamine, dipropylamine, butylamine, isobutylamine, triethanolamine, diethanolamine, aminomethylpropanol and morpholine. The compound for forming the salt may be used in any amount, as long as it is added in an amount equal to or more than the neutralization equivalent of a dispersing agent composed of an organic compound before the salt formation. However, from the viewpoint of fixing properties after printing, the amount thereof added is preferably about 1.3 times the neutralization equivalent.

The weight average molecular weight of the copolymer is preferably from 1,000 to 50,000, and more preferably from 3,000 to 10,000.

The amount of such a polymer type dispersing agent added is preferably from 1 to 50% by weight, and more preferably from 2 to 30% by weight, based on the pigment.

In particular, the aqueous pigment ink as exemplified above can be designed to become optimum from the viewpoints of dispersion stability of the aqueous pigment ink and image quality of one dot. However, printing on a glossy medium causes the difference in glossiness between a high duty region and a low duty region because the polymer type dispersing agent has glossiness. Accordingly, when the printed matter is observed as a whole, uneven gloss is liable to become obvious. In order to solve this problem, when the clear ink is printed in such amounts that the amount thereof in the low duty region is larger than that in the high duty region, thereby intending to decrease the difference in glossiness between the high duty region and the low duty region, the ink jet recording process of the embodiment of the first invention having the above-mentioned dot omission detecting step is extremely effective.

The clear ink which can be suitably used in the embodiment of the first invention will be described below.

The clear ink is an ink capable of imparting glossiness, and suitable examples thereof include a form containing water and fine polymer particles and containing no colorant, or a form containing water, fine polymer particles and a colorant in such an amount that the hue thereof is visually unobservable (for example, a form containing a yellow dye having high brightness in an extremely slight amount for a specified purpose).

Specific examples of the polymers constituting the fine polymer particles include an acrylic resin, a vinyl acetate resin, a styrene-butadiene resin, vinyl chloride resin, an acrylic-styrenic resin, a butadiene resin, a styrenic resin, a crosslinked acrylic resin, a crosslinked styrene resin, a benzoguanamine resin, a phenol resin, a silicone resin, a methacrylic acid resin, a urethane resin, an acrylamide resin, an epoxy resin and a mixture thereof. These polymers are not limited according to the form of copolymerization, and may be ones existing, for example, in the form of a block copolymer or a random copolymer.

It is particularly preferred that the fine polymer particles comprise a polymer containing an acrylate and/or a methacrylate as a main component.

The above-mentioned fine polymer particles preferably form an emulsion in the clear ink to perform colloidal dispersion. That is to say, the fine polymer particles are preferably added to the clear ink in the emulsion form.

The average particle size of the above-mentioned fine polymer particles is preferably 70 nm or more, and more preferably from 100 nm to 150 nm. When the size of the fine polymer particles is within this range, the fine polymer particles become easy to form an emulsion in water to give a high-quality recorded image.

In the above-mentioned clear ink, when the fine polymer particles have such specific physical properties, they disperse in the clear ink as a milk-white emulsion.

From the viewpoints of improvement in glossiness and improvement in stability of the recorded image, the glass transition temperature (Tg: measured according to JIS K6900) of the above-mentioned fine polymer particles is preferably 20° C. or lower, and more preferably 10° C. or lower.

From the viewpoints of improvement in glossiness and improvement in stability of the recorded image, the minimum film forming temperature (MFT) of the above-mentioned fine polymer particles is preferably 20° C. or lower, and more preferably 0° C. or lower. When the minimum film forming temperature (MFT) of the above-mentioned fine polymer particles is within this range, the effect of improving glossiness in an unprinted area of the recorded image is more significant.

From the viewpoints of improvement in glossiness and improvement in stability of the recorded image, the weight average molecular weight (Mw) of the above-mentioned fine polymer particles is preferably from 100,000 to 1,000,000, and more preferably from 400,000 to 600,000. When the weight average molecular weight (Mw) of the above-mentioned fine polymer particles is within this range, the effect of improving glossiness in an unprinted area of the recorded image is more significant.

From the viewpoints of improvement in glossiness and improvement in stability of the recorded image, the content of the above-mentioned fine polymer particles (in terms of solid content) in the clear ink is preferably from 0.1 to 5.0% by weight, and more preferably from 0.1 to 2.0% by weight.

The fine polymer particles may be added alone or as a mixture of two or more thereof. When they are added as the mixture, the total content thereof in the clear ink is preferably from 0.1 to 5.0% by weight (more preferably from 0.1 to 2.0% by weight).

As the water, there can be used any of pure water such as ion-exchanged water, ultrafiltrated water, reverse osmosis water and distilled water, and ultra pure water. Further, the use of those obtained by sterilizing the above-described water by ultraviolet-ray irradiation or the addition of hydrogen peroxide is more preferred because the development of fungi or bacteria is inhibited.

The above-mentioned aqueous dye ink, aqueous pigment ink and clear ink (these are also generally referred to simply as the "ink" hereinafter) may further contain any one of an acetylene glycol-based compound, an acetylene alcohol-based compound and a polysiloxane-based compound as a surfactant.

This makes it possible to enhance ejection stability of the ink without deteriorating color development properties and glossiness.

The content of the surfactant in the ink is preferably from 0.1 to 3.0% by weight, and more preferably from 0.1 to 1.0% by weight.

From the viewpoint of improvement in ejection stability, the surface tension of the clear ink is preferably from 15 to 45 mN/m, and more preferably from 25 to 35 mN/m.

The surface tension of the clear ink is preferably 40 mN/m or less from the viewpoint of conducting the process according to the embodiment of the first invention. This makes it possible to sufficiently secure the difference between the "diameter of the dot of only the image formation ink" and the "diameter of the dot comprising the image formation ink and the clear ink one over the other", so that the dot omission of the clear ink can be judged more easily.

As the acetylene glycol-based compounds, there can be used commercially available products such as Olfine E1010, STG and Y (trade names, manufactured by Nissin Chemical Industry Co., Ltd.) and Surfynol 82, 104, 440, 465 and 485 (trade names, manufactured by Air Products and Chemicals Inc.).

As the acetylene alcohol-based compounds, there can be used 3,5-dimethyl-1-hexyne-3-ol, 2,4-dimethyl-1-hexyne-3-ol and Surfynol 61 (trade name, manufactured by Air Products and Chemicals Inc.).

As the polysiloxane-based compounds, there can be used compounds represented by the following general formula:

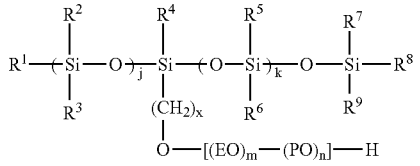

wherein $R^1$ to $R^9$ each independently represents a $C_{1-6}$ alkyl group, j, k and x each independently represents an integer of 1 or more, EO represents an ethyleneoxy group, PO represents a propyleneoxy group, and m and n each represents an integer of 0 or more, but m+n is an integer of 1 or more, and EO and PO in the brackets may be present in any order and may be arranged either in a random form or a block form.

The ink may further contain a glycol ether-based compound or an alkyl diol-based compound. The use of these compounds as solvents can enhance image quality of the recorded image without deteriorating color development properties and glossiness. From the viewpoint of improvement in image quality, the content of these compounds (when plural kinds of compounds are mixed, the total amount thereof) in the ink is preferably from 1.0 to 30% by weight, and more preferably from 1.0 to 10% by weight.

The glycol ether-based compounds include triethylene glycol monobutyl ether, diethylene glycol monobutyl ether, propylene glycol monomethyl ether, diethylene glycol monoethyl ether and diethylene glycol monomethyl ether. In particular, triethylene glycol monobutyl ether is preferred.

The alkyl diol-based compounds include 1,2-hexanediol and 1,2-pentanediol. In particular, 1,2-hexanediol is preferred.

The ink may further contain a polyhydric alcohol-based compound. The polyhydric alcohol-based compounds include water-soluble organic solvents such as glycerol, ethylene glycol, triethylene glycol, polyethylene glycol, diethylene glycol, pentamethylene glycol, trimethylene glycol, 2-butene-1,4-diol, 2-ethyl-1,3-hexanediol, 2-methyl-2, 4-pentanediol, dipropylene glycol and tetraethylene glycol. In particular, glycerol is preferred.

The content of the polyhydric alcohol-based compounds (when plural kinds of compounds are mixed, the total amount thereof) in the ink is preferably from 5.0 to 40% by weight, and more preferably from 10 to 30% by weight.

The ink can further contain a solvent generally used in an aqueous ink composition for ink jet recording as needed. Such solvents include 2-pyrrolidone, triethanolamine and saccharides.

Specific examples of the saccharides include monosaccharides, disaccharides, oligosaccharides (including trisaccharides and tetrasaccharides) and poly-saccharides, and preferred examples thereof include glucose, mannose, fructose, ribulose, xylose, arabinose, galactose, aldonic acid, glucitol, sorbit, maltose, cellobiose, lactose, sucrose, trehalose and maltotriose. The term "polysaccharide" as used herein means a saccharide in a broad sense, including materials widely existing in the natural world such as alginic acid, α-cyclodextrin and cellulose. Further, derivatives of these saccharides include reducing sugars of the saccharides described above (for example, a sugar alcohol represented by general formula $HOCH_2(CHOH)_nCH_2OH$ (wherein n represents an integer of 2 to 5)), oxidized sugars (for example, aldonic acid and uronic acid), amino acids and thiosaccharides. In particular, the sugar alcohol is preferred, and specific examples thereof include maltitol and sorbit. Further, as commercially available products, HS-300 and HS-500 (registered trade mark, Hayashibara Shoji, Inc.) are available.

The ink can further contain an auxiliary agent. Such auxiliary agents include a pH adjustor, a chelating agent, a preservative, a rust inhibitive agent, an antioxidant, an UV absorber, an oxygen absorber and an abrasion resistance improver.

As described above, according to the ink jet recording process according to the embodiment of the first invention, when the image formation ink and the transparent clear ink are recorded one over the other, the dot diameter thereof is enlarged compared to that of the ink alone. The dot omission of the clear ink can be detected by utilizing this, so that it can be reliably detected whether the image formation ink is covered with the transparent clear ink or not.

As another embodiment of the first invention, a single dot may be formed in a region other than that where the mixed dot is formed on the recording medium, by independently recording the image formation ink, and the reference value may be prepared based on the diameter of the single dot. The conditions applied to the preparation of the mixed dot (the kind of image formation ink and recording medium, environmental conditions (humidity and temperature), etc.) are reliably reflected thereby, so that the reliability of the reference value can be increased.

Figure 4:
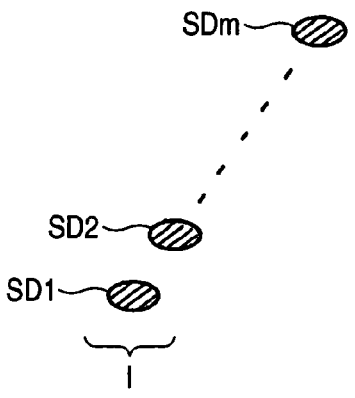
FIG. 4 is a view for illustrating an ink jet recording process according to another embodiment of the invention.
Figure 4:
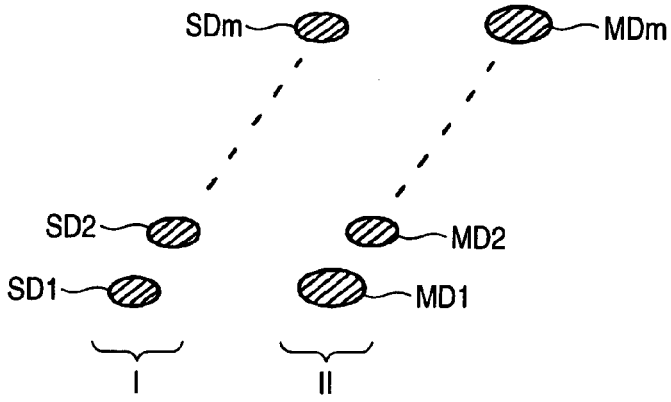
Figure 5:
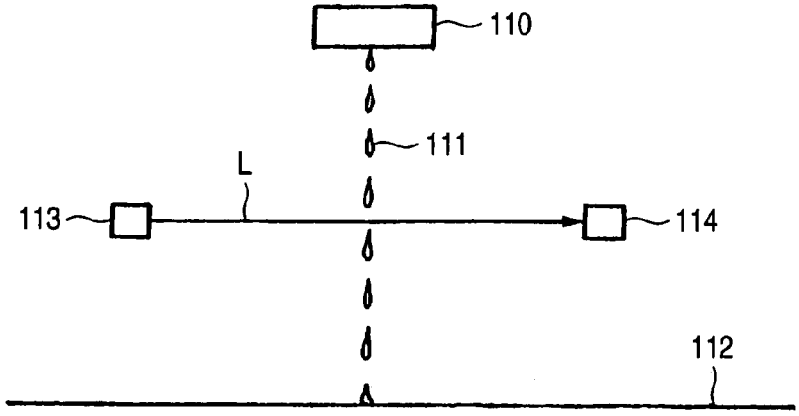
FIG. 5 is a view for illustrating a conventional dot omission detecting method.

More specifically, there can be preferably exemplified a process of conducting a step of forming a single dot in a region I other than that where a mixed dot is formed, measuring the diameter of the single dot and preparing the reference value so as to satisfy the following equation (first step: see FIG. 4(*a*)), a step of forming a mixed dot in a region II other than the above-mentioned region I and measuring the diameter of the mixed dot (second step: see FIG. 4(*b*)), and a step of comparing the diameter of the mixed dot to the reference value to judge the dot omission of the clear ink (third step), in this order.

$$\text{Reference value}=\text{Diameter of single dot}+\alpha\ (\alpha\geqq 0)$$

For a mixed dot MD1 formed by recording the clear ink ejected from an ejection orifice c1 for the clear ink and the image formation ink ejected from an ejection orifice $P_{a1}$ (a is any integer of 1 to n, wherein n is the same as described above) for the image formation ink, one over the other, a value based on a single dot SD1 (single dot SD1+α (α≧0)) formed by the image formation ink alone is preferably used as the reference value. That is to say, for a mixed dot MDb (b is any integer of 1 to m, wherein m is the same as described above), a value based on a single dot SDb (single dot SDb+α (α≧0)) is preferably used as the reference value.

By taking α as a value exceeding 0 herein, the error of the diameter of the mixed dot produced by the difference in use conditions can be absorbed.

There is no particular limitation on the order of the above-mentioned first step and second step.

Further, in the ink jet recording process of the embodiment of the invention, the ink jet recording is carried out when the dot omission of the clear ink is judged as absent by the above-mentioned dot omission detecting step, and the cleaning of the above-mentioned recording head is conducted when the dot omission of the clear ink is judged as present.

In this embodiment, the cleaning of the recording head can be conducted by an appropriate combination of operations of (1) to (3) shown below.

(1) The carriage 54 is moved toward the home position or so as to go away from the home position, thereby bringing the recording head 56 into slidable contact with the wiping member 80 to clean up foreign matter such as dust adhered to an outer surface of the recording head 56.

(2) The carriage 54 is moved to the home position, the recording head 56 is capped with the capping member 72, and the pump 76 is actuated to place the recording head 56 under negative pressure, thereby forcedly discharging foreign matter with which the inside of the ink ejection orifice is clogged.

(3) The carriage 54 is moved to the home position, and the recording head 56 is capped with the capping member 72. In this state, a driving signal unrelated to the recording head 56 is applied to eject ink droplets (this is usually called a flushing operation). The ink ejected to the capping member 72 is discharged by actuating the pump 76.

As described above, according to the ink jet recording process according to the embodiment of the first invention, for example, even when the recording head is intended to be actuated again after it has not been actuated for a long period of time because of a shutdown of printing etc., the ink jet recording can be carried out as such without conducting the cleaning of the recording head 56, in the case where the dot omission of the clear ink is judged as absent. Accordingly, the printing can be rapidly conducted.

Further, as described above, the ink jet recording apparatus according to the embodiment of the first invention is constituted so that the presence or absence of the dot omission of the clear ink is judged depending on the diameter of the mixed dot and either "ink jet recording with the recording head" or "cleaning of the recording head with the cleaning mechanism" can be selected by the result of this judgment. According this, when the dot omission of the clear ink is judged as absent, "ink jet recording with the recording head" is selected, and when the dot omission of the clear ink is judged as present, "cleaning of the recording head with the cleaning mechanism" is selected, thereby being able to provide the ink jet recording apparatus which can reliably reproduce the image composed of the mixed dots.

According to the ink jet recording process of the first invention, there can be provided the ink jet recording process which can reliably detect the dot omission of the clear ink, when the image formation ink and the clear ink are recorded one over the other on the recording medium.

Further, according to the ink jet recording apparatus of the first invention, there can be provided the ink jet recording apparatus which can reliably reproduce the image, when the image formation ink and the clear ink are recorded one over the other on the recording medium.

The ink jet recording process according to an embodiment of the second invention can be suitably conducted using an ink jet recording apparatus 5' according to an embodiment of the second invention shown in FIG. 1.

First, the ink jet recording apparatus 5' according to the embodiment of the second invention will be illustrated in detail. The ink jet recording apparatus 5' is an ink jet recording apparatus capable of applying an image formation ink and a reactive clear ink one over the other onto a recording medium with a recording head to form a mixed dot, and comprises an image density measuring unit capable of measuring the image density of the mixed dot, a judging unit capable of judging the presence or absence of dot omission of the reactive clear ink depending on the image density of the mixed dot, a cleaning mechanism capable of cleaning the recording head, and a control unit capable of selecting either "ink jet recording with the recording head" or "cleaning of the recording head with the cleaning mechanism" depending on the result of the judgment by the judging unit.

More particularly, the ink jet recording apparatus 5' has a printing unit 51, a discharge roller 52 and a driven roller 53 driven by the discharge roller 52. Recording paper 55 on which an image has been recorded in the printing unit 51 is discharged by being pinched with the discharge roller 52 and the driven roller 53, as shown in FIG. 1.

The printing unit 51 has a carriage 54 for placing an ink cartridge thereon, a recording head 56 which is disposed on the carriage 54 on the side facing to the recording paper 55 and ejects an ink, a timing belt 57, a carriage motor 58, a reactive clear ink cartridge 59 and an image formation ink cartridge 60.

Further, this ink jet recording apparatus 5' is provided with an ink waste water conveying unit 70 for conveying as waste water the ink discharged from the recording head 56 of the printing unit 51 and a wiping member 80, as the above-mentioned cleaning mechanism.

The ink waste water conveying unit 70 has a capping member 72 for sealing ejection orifices of the recording head 56, and a pump 76. Foreign matter in the ejection orifices of the recording head 56 and the ink ejected to the capping member 72 are sucked with the pump 76 to be discharged.

The above-mentioned capping member 72 is disposed in a so-called home position outside a printing region as a supply path of the recording paper 55.

The wiping member 80 has elasticity and disposed in the vicinity of an end on a recording region side of the capping member 72. This wiping member 80 is injection molded integrally with the capping member 72 by a two-color formation process.

In this ink jet recording apparatus 5, the carriage motor 58 drives the timing belt 57, whereby the carriage 54 is guided by a guide shaft (not shown) to move back and forth at substantially right angles to a feeding direction of the recording paper 55.

In this ink jet recording apparatus 5', the carriage motor 58 drives the timing belt 57, whereby the carriage 54 is guided by a guide shaft (not shown) to move back and forth at substantially right angles to a feeding direction of the recording paper 55.

The above-mentioned recording head 56 is mounted on the carriage 54 on the side facing to the recording paper 55. The reactive clear ink cartridge 59 and image formation ink cartridge 60 for supplying the ink to the recording head 56 are detachably attached to an upper part of the recording head 56.

As shown in FIG. 2, the recording head 56 is provided with ejection orifices C1 to Cm for the reactive clear ink and ejection orifices $P_{11}$ to $P_{nm}$ for the image formation ink, on the side facing to the recording paper 55, wherein n represents an integer of 1 or more and indicates the order of the ejection orifices for the image formation ink in the X direction, whereas m represents an integer of 1 or more and indicates the order of the ejection orifices for the reactive clear ink and the image formation ink in the Y direction.

Further, the carriage 54 is equipped with a CCD camera 82 as a first constituent element of a dot image density measuring device capable of detecting the image density of a dot on the recording paper 55.

The CCD camera is electrically connected to an image density calculation device 84 (a second constituent element of the dot image density measuring device, ) capable of calculating the dot image density based on the dot information measured with the CCD camera. For example, the image density calculation device is constituted so that various reference data relating to the image density have been stored therein beforehand and the dot information is compared to the reference data to calculate the dot image density. The image density calculation device is electrically connected to a judging device (not shown) capable of judging the presence of absence of dot omission of the reactive clear ink depending on the image density calculated by the image density calculation device, and the judging device is further electrically connected to a control device (not shown) having the above-mentioned function. A reference value d to be compared to the dot image density calculated by the image density calculation device has been stored in the judging device beforehand. The reference value d is appropriately set in view of the kind of reactive clear ink, image formation ink and recording medium, external environmental conditions (humidity and temperature), etc. Further, the control device is constituted so that when the dot omission of the reactive clear ink is judged as absent by the judging device, it actuates the recording head 56 to carry out the ink jet recording, and when the dot omission of the reactive clear ink is judged as present, it actuates the cleaning mechanism to clean the recording head 56.

Then, the ink jet recording process according to an embodiment of the second invention using the ink jet recording apparatus 5' will be illustrated.

First, single dots SD1 to SDm are formed at specified positions on the recording medium as shown in FIG. 3(*a*), using any one line of orifices in the Y direction of the ejection orifices $P_{11}$ to $P_{nm}$ for the image formation ink provided on the recording head 56 (m is the same as described above). As the recording medium, there can be employed a known medium such as plain paper or a recording medium for ink jet recording (a recording medium having on a surface thereof an ink receiving layer for receiving an ink jet recording ink).

Secondly, the reactive clear ink is ejected from the ejection orifices C1 to Cm for the reactive clear ink provided on the recording head 56 so as to cover the single dots SD1 to SDm to prepare mixed dots MD1 to MDm as shown in FIG.

3(*b*) (m is the same as described above). In this specification, the term "mixed dot" means a dot on a recording medium after the ejection operation of the reactive clear ink has been conducted, regardless of whether the ejection orifices C1 to Cm for the reactive clear ink have a fault or not.

Then, the image densities d1 to dm of the mixed dots MD1 to MDm are measured with the CCD camera and the image density calculation device (m is the same as described above). The image densities d1 to dm measured are compared to the specified reference value d set beforehand to thereby detect the dot omission of the reactive clear ink (dot omission detecting step). In this embodiment, the reference value d is set within the range of the "image density of the dot of only the image formation ink" to the "image density of the dot comprising the image formation ink and the reactive clear ink one over the other". When the image densities d1 to dm of the mixed dots exceed the reference value d, the dot omission of the reactive clear ink is judged as absent, and when the image densities of the mixed dots are equal to or less than the reference value d, the dot omission of the reactive clear ink is judged as present. For example, when the image density d1 of the mixed dot MD1 exceeds d, the dot omission of the reactive clear ink is judged as absent, and it is regarded that the reactive clear ink has been ejected from the ejection orifice C1 for the reactive clear ink without a problem. On the other hand, when the image density d2 of the mixed dot MD2 is d or less, the dot omission of the reactive clear ink is judged as present, and it is regarded that a defect of some kind has been developed in the ejection orifice C2 for the reactive clear ink, whereby the reactive clear ink has not been normally ejected.

As the image formation inks, there can be used any of the known aqueous dye inks and aqueous pigment inks described in the above-mentioned first invention.

In particular, the aqueous pigment ink as exemplified in the first invention can be designed to become optimum from the viewpoints of dispersion stability of the aqueous pigment ink and image quality of one dot. However, printing on a glossy medium causes the difference in glossiness between a high duty region and a low duty region because the polymer type dispersing agent has glossiness. Accordingly, when the printed matter is observed as a whole, uneven gloss is liable to become obvious. In order to solve this problem, when the clear ink is printed in such amounts that the amount thereof in the low duty region is larger than that in the high duty region, thereby intending to decrease the difference in glossiness between the high duty region and the low duty region, the ink jet recording process of the embodiment of the invention having the above-mentioned dot omission detecting step is extremely effective.

The reactive clear ink which can be suitably used in the embodiment of the second invention will be illustrated below.

The reactive clear ink is an ink which imparts glossiness and reacts with a colorant (such as an anionic dye or an anionic pigment) on a recording medium to improve print quality, and suitable examples thereof include a form containing water, fine polymer particles and a reactant and not containing a colorant.

As for the water and the fine polymer particles, ones described in the above-mentioned first invention can be similarly used.

The reactant is an agent which can destroy the dispersed and/or dissolved state of the pigment and/or fine polymer particles in the ink and coagulate the pigment and/or fine polymer particles. Examples thereof include a cationic resin and a multivalent metal salt.

The above-mentioned cationic resin may be an amino group-containing resin or a polyethyleneimine.

As the polyethyleneimine, there is suitable a polymer containing at least one repeating unit represented by the following general formula (1):

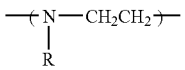

(1)

wherein R is hydrogen, an alkyl group which may be substituted, an aryl group which may be substituted, a pyridyl group which may be substituted, an alkylamino group which may be substituted or a hydrazino group which may be substituted.

The above-mentioned structure more improves color development properties of the recorded image and glossiness.

From the viewpoints of improvement in color development properties, glossiness and storability of the reactive clear ink, the weight average molecular weight (Mw) of the above-mentioned polyethyleneimine is preferably 100,000 or less, more preferably from 100 to 10,000, and still more preferably from 100 to 5,000.

The above-mentioned polyethyleneimine is obtained by ring-opening polymerization of ethyleneimine in the presence of a catalyst such as carbon dioxide, hydrochloric acid, hydrobromic acid, p-toluenesulfonic acid, aluminum chloride or boron trifluoride, or polycondensation of ethylene chloride with an ethylenediamine compound.

Specific examples of the polymers containing at least one repeating unit represented by general formula (1) are shown below.

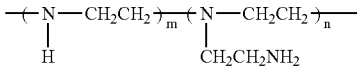

(1-1)

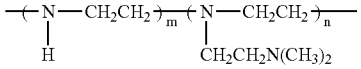

(1-2)

wherein m and n are such numerical values that the weight average molecular weight (Mw) of the polyethyleneimine becomes 100,000 or less.

The polyethyleneimine used may be partly anion modified or cation modified at side chains or terminals.

From the viewpoints of improvement in color development properties and improvement in glossiness, the content of the above-mentioned polyethyleneimine in the reactive clear ink is preferably from 0.1 to 30.0% by weight, more preferably from 0.1 to 5.0% by weight, and still more preferably from 0.1 to 2.0% by weight.

The polyethyleneimines may be added either alone or as a mixture of two or more thereof. When they are added as a mixture, the total content thereof is preferably from 0.1 to 5.0% by weight, and more preferably from 0.1 to 2.0% by weight.

The above-mentioned cationic resin may be polyvinylamine, polyamidepolyamine, polyamidine, polydimethylaminoethyl methacrylate or polydimethylaminoethyl acrylate as described below.

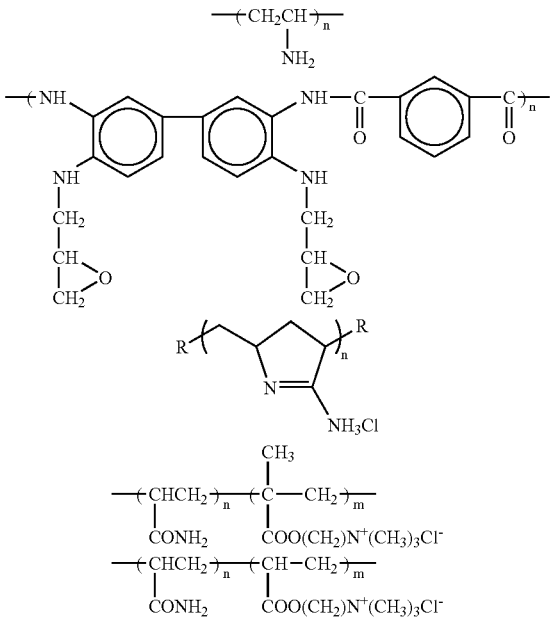

Further, the cationic resins include polyallylamine and a polyallylamine derivative. Polyallylamine and the polyallylamine derivative are soluble in water, and positively charged in water. Examples thereof include compounds represented by the following formulas (VI), (VII) and (VIII):

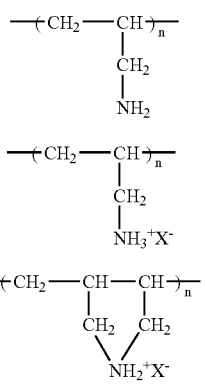

(VI)

(VII)

(VIII)

wherein $X^-$ represents a chloride ion, a bromide ion, a iodide ion, a nitrate ion, a phosphate ion, a sulfate ion or an acetate ion.

In addition to the above, a polymer obtained by copolymerization of allylamine and diallylamine and a copolymer of diallylmethylammonium chloride and sulfur dioxide can be used.

The content of these polyallylamine and polyallylamine derivative is preferably from 0.5 to 10% by weight based on the reactive clear ink.

The multivalent metal salt is composed of a multivalent metal ion of bivalence or higher valence and an anion bound to the multivalent metal ion, and soluble in water. Specific examples of the multivalent metal ions include bivalent metal ions such as $Ca^{2+}$, $Cu^{2+}$, $Ni^{2+}$, $Mg^{2+}$, $Zn^{2+}$ and $Ba^{2+}$, and trivalent metal ions such as $Al^{3+}$, $Fe^{3+}$ and $Cr^{3+}$. The anions include $Cl^-$, $NO^{3-}$, $I^-$, $Br^-$, $ClO^{3-}$ and $CH_3COO^-$.

Above all, the metal salt formed by $Ca^{2+}$ or $Mg^{2+}$ gives suitable results from the two viewpoints of the pH of the reactive clear ink and quality of printed matter.

Although the concentration of the multivalent metal salt in the reactive clear ink may be appropriately decided within the range in which improvement in print quality and the effect of preventing clogging are obtained, it is preferably from about 0.1 to about 40% by weight, and more preferably from about 5 to about 25% by weight.

According to a preferred embodiment of the second invention, the multivalent metal salt contained in the reactive clear ink is composed of a multivalent metal ion of bivalence or higher valence and a nitrate ion or a carboxylate ion bound to the multivalent metal ion, and soluble in water.

The carboxylate ion as used herein is preferably derived from a saturate aliphatic monocarboxylic acid having 1 to 6 carbon atoms or a carbocyclic monocarboxylic acid having 7 to 11 carbon atoms. Preferred examples of the saturate aliphatic monocarboxylic acids having 1 to 6 carbon atoms include formic acid, acetic acid, butyric acid, isobutyric acid, valeric acid, isovaleric acid, pivalic acid and hexanoic acid. In particular, formic acid and acetic acid are preferred.

A hydrogen atom on a saturated aliphatic hydrocarbon group of the monocarboxylic acid may be substituted by a hydroxyl group, and preferred examples of such carboxylic acids include lactic acid.

Further, preferred examples of the carbocyclic monocarboxylic acids having 7 to 11 carbon atoms include benzoic acid and naphthoic acid, and benzoic acid is more preferred.

According to a preferred embodiment of the second invention, the reactive clear ink comprises a polyol, in addition to the multivalent metal salt. The polyol as used herein has a vapor pressure of 0.01 mmHg or less at 20° C., and the amount thereof added is 1 or more, and preferably from 1.0 to 5.0, by weight ratio based on the multivalent metal salt. Further, according to a preferred embodiment of the invention, the amount of the polyol added is preferably 10% by weight or more, and more preferably from about 10 to about 30% by weight, based on the reactive clear ink.

Preferred specific examples of the polyols include polyhydric alcohols such as glycerol, diethylene glycol, triethylene glycol, 1,5-pentanediol and 1,4-butanediol. Further, preferred specific examples of the polyols include saccharides, for example, monosaccharides, disaccharides, oligosaccharides (including trisaccharides and tetrasaccharides) and polysaccharides, and preferred examples thereof include glucose, mannose, fructose, ribulose, xylose, arabinose, galactose, aldonic acid, glucitol, sorbit, maltose, cellobiose, lactose, sucrose, trehalose and maltotriose.

These polyols may be added either alone or as a mixture of two or more thereof. When they are added as a mixture, the total amount thereof added is 1 or more by weight ratio based on the multivalent metal salt.

The above-mentioned aqueous dye ink, aqueous pigment ink and reactive clear ink (these are hereinafter also generally referred to simply as the "ink" hereinafter) may further contain an acetylene glycol-based compound, an acetylene alcohol-based compound or a polysiloxane-based compound as a surfactant.

This makes it possible to enhance ejection stability of the ink without deteriorating color development properties and glossiness.

The content of the surfactant in the ink is preferably from 0.1 to 3.0% by weight, and more preferably from 0.1 to 1.0% by weight.

From the viewpoint of improvement in ejection stability, the surface tension of the clear ink is preferably from 15 to 45 mN/m, and more preferably from 25 to 35 mN/m.

The ink may further contain the glycol ether-based compound or alkyl diol-based compound exemplified in the first invention. The use of these compounds as solvents can enhance image quality of the recorded image without deteriorating color development properties and glossiness. From the viewpoint of improvement in image quality, the content of these compounds (when plural kinds of compounds are mixed, the total amount thereof) in the ink is preferably from 1.0 to 30% by weight, and more preferably from 1.0 to 10% by weight.

The ink may further contain the polyhydric alcohol-based compound exemplified in the first invention.

The content of the polyhydric alcohol-based compounds (when plural kinds of compounds are mixed, the total amount thereof) in the ink is preferably from 5.0 to 40% by weight, and more preferably from 10 to 30% by weight.

The above-mentioned ink can further contain the solvent or auxiliary agent exemplified in the first invention, as needed.

As described above, according to the ink jet recording process according to the embodiment of the second invention, when the image formation ink and the transparent reactive clear ink are recorded one over the other, the image density of the dot increases compared to that of the image formation ink alone. The dot omission of the reactive clear ink can be detected by utilizing this, so that it can be reliably detected whether the image formation ink is covered with the transparent reactive clear ink or not.

As another embodiment of the second invention, a single dot may be formed in a region other than that where the mixed dot is formed on the recording medium, by independently recording the image formation ink, and the reference value may be prepared based on the image density of the single dot. The conditions applied to the preparation of the mixed dot (the kind of image formation ink and recording medium, environmental conditions (humidity and temperature), etc.) are reliably reflected thereby, so that the reliability of the reference value can be increased.

More specifically, there can be preferably exemplified a process of conducting a step of forming a single dot in a region I other than that where a mixed dot is formed, measuring the image density of the single dot and preparing the reference value so as to satisfy the following equation (first step: see FIG. 4(*a*)), a step of forming a mixed dot in a region II other than the above-mentioned region I and measuring the image density of the mixed dot (second step: see FIG. 4(*b*)), and a step of comparing the image density of the mixed dot to the reference value to judge the dot omission of the reactive clear ink (third step), in this order.

$$\text{Reference value} = \text{Image density of single dot} + \alpha \quad (\alpha \geqq 0)$$

For a mixed dot MD1 formed by recording the reactive clear ink ejected from an ejection orifice c1 for the reactive clear ink and the image formation ink ejected from an ejection orifice $P_{a1}$ (a is any integer of 1 to n, wherein n is the same as described above) for the image formation ink, one over the other, a value based on a single dot SD1 (single dot SD1+α (α≧0)) formed by the image formation ink alone is preferably used as the reference value.

By taking α as a value exceeding 0 herein, the error of the image density of the mixed dot produced by the difference in use conditions can be absorbed.

There is no particular limitation on the order of the above-mentioned first step and second step.

Further, in the ink jet recording process of the embodiment of the second invention, the ink jet recording is carried out when the dot omission of the reactive clear ink is judged as absent by the above-mentioned dot omission detecting step, and the cleaning of the above-mentioned recording head is conducted when the dot omission of the reactive clear ink is judged as present.

In this embodiment, the cleaning of the recording head can be conducted by an appropriate combination of the operations of (1) to (3) shown in the first invention.

As described above, according to the ink jet recording process according to the embodiment of the second invention, for example, even when the recording head is intended to be actuated again after it has not been actuated for a long period of time because of a shutdown of printing etc., the ink jet recording can be carried out as such without conducting the cleaning of the recording head 56, in the case where the dot omission of the reactive clear ink is judged as absent. Accordingly, the printing can be rapidly conducted.

Further, as described above, the ink jet recording apparatus according to the embodiment of the second invention is constituted so that the presence or absence of the dot omission of the reactive clear ink is judged depending on the image density of the mixed dot and either "ink jet recording with the recording head" or "cleaning of the recording head with the cleaning mechanism" can be selected by the result of this judgment. According this, when the dot omission of the reactive clear ink is judged as absent, "ink jet recording with the recording head" is selected, and when the dot omission of the reactive clear ink is judged as present, "cleaning of the recording head with the cleaning mechanism" is selected, thereby being able to provide the ink jet recording apparatus which can reliably reproduce the image composed of the mixed dots.

According to the ink jet recording process of the second invention, there can be provided the ink jet recording process which can reliably detect the dot omission of the reactive clear ink, when the image formation ink and the reactive clear ink are recorded one over the other on the recording medium.

Further, according to the ink jet recording apparatus of the second invention, there can be provided the ink jet recording apparatus which can reliably reproduce the image, when the image formation ink and the reactive clear ink are recorded one over the other on the recording medium.

While the present invention has been described in detail and with reference to specific embodiments thereof, it will be apparent to one skilled in the art that various changes and modifications can be made therein without departing from the spirit and scope thereof.

This application is based on Japanese Patent Application Nos. 2003-13564 and 2003-13565, the contents thereof being incorporated herein by reference.

What is claimed is:

1. An ink jet recording process comprising the steps of:

(a) applying an image formation ink and a reactive clear ink one over the other onto a recording medium with a recording head to form a dot which may be a mixed dot comprising the image formation ink and the reactive clear ink, or a dot omission, comprising the image formation ink but not the clear ink; and (b) detecting dot omission, in which the presence or absence of dot omission of a first dot is judged by measuring the image density of the first dot, wherein the dot omission detecting step is a step of judging the dot omission of the reactive clear ink as absent when the image density of the first dot exceeds a reference value, and judging the dot omission of the reactive clear ink as present when the image density of the first dot is equal to or less than the reference value, wherein the reference value is based on the image density of a single dot formed by independently recording with the image formation ink only, and wherein the reference value satisfies the following equation:

$$\text{Reference value}=\text{Image density of the single dot}+\alpha$$

wherein $\alpha \geqq 0$.

2. The ink jet recording process according to claim 1, which further comprises a step of carrying out ink jet recording when the dot omission of the reactive clear ink is judged as absent by the dot omission detecting step, and carrying out cleaning of the recording head when the dot omission of the reactive clear ink is judged as present by the dot omission detecting step.

3. An ink jet recording apparatus capable of applying an image formation ink and a reactive clear ink one over the other onto a recording medium with a recording head to form a dot which may be a mixed dot, comprising the image formation ink and the reactive clear ink, or a dot omission, comprising the image formation ink but not comprising the reactive clear ink, said apparatus comprising:

an image density measuring unit capable of measuring the image density of a dot;

a judging unit capable of judging the presence or absence of dot omission of the reactive clear ink depending on whether the image density of the dot measured by the measuring unit is equal to or less than a reference value stored in the judging unit, wherein the reference value stored in the judging unit is based on the image density of a single dot formed by independently recording with the image formation ink only and wherein the reference value satisfies the following equation:

$$\text{Reference value}=\text{Image density of the single dot}+\alpha$$

wherein $\alpha \geqq 0$;

a cleaning mechanism capable of cleaning the recording head; and a control unit capable of causing either recording with the recording head or cleaning of the recording head with the cleaning mechanism depending on whether the judging unit judges that the image density of the measured dot is equal to or less than the reference value.

* * * * *